United States Patent [19]

Soma et al.

[11] 4,299,902

[45] Nov. 10, 1981

[54] IMAGE FORMING PROCESS AND APPARATUS THEREFOR

[75] Inventors: Ikuo Soma, Yokohama; Tamotu Magome, Kawasaki; Toru Matsumoto, Kita, all of Japan

[73] Assignee: Canon Kabushiki Kaisha, Tokyo, Japan

[21] Appl. No.: 925,749

[22] Filed: Jul. 18, 1978

[30] Foreign Application Priority Data

Jul. 26, 1977 [JP] Japan ..... 52-89666

[51] Int. Cl.[3] ..... B05D 1/28

[52] U.S. Cl. ..... 430/125; 118/659; 118/661; 118/241; 355/10

[58] Field of Search ..... 427/15, 17; 118/659, 118/661; 355/10; 118/241; 430/125

[56] References Cited

U.S. PATENT DOCUMENTS

| | | | |
|---|---|---|---|
| 3,743,407 | 7/1973 | Smith | 355/10 |
| 3,800,743 | 4/1974 | Egnaczak | 118/241 |
| 3,908,594 | 9/1975 | Matsumoto et al. | 118/661 X |
| 3,942,474 | 3/1976 | Smith et al. | 427/15 |
| 4,010,288 | 3/1977 | Souma | 427/15 |
| 4,021,586 | 5/1977 | Matkan | 427/17 |

FOREIGN PATENT DOCUMENTS

| | | |
|---|---|---|
| 48-66844 | 9/1973 | Japan . |
| 52-40336 | 3/1977 | Japan . |
| 52-55644 | 5/1977 | Japan . |

*Primary Examiner*—Shrive P. Beck

*Attorney, Agent, or Firm*—Fitzpatrick, Cella, Harper & Scinto

[57] ABSTRACT

An image forming process including a step of developing an electrostatic image by supplying a liquid developer to a surface holding said image thereon, which comprises conducting said development when a liquid developer supply member capable, upon elastic deformation thereof, of squeezing out and absorbing said liquid developer is brought into pressure contact with said image-holding surface, and, when said development is not performed, separating said supply member from said surface and maintaining said supply member in a state wetted with said liquid developer. And also an image forming apparatus which is adapted for use in such process.

6 Claims, 8 Drawing Figures

IMAGE FORMING PROCESS AND APPARATUS THEREFOR

BACKGROUND OF THE INVENTION

1. Field of the Invention

The present invention relates to an image forming process comprising a step of developing an electrostatic latent image formed for example in an electrophotographic process or an electrostatic recording process by means of a liquid developer, and also to a novel apparatus adapted for use in such process.

In the prior art of image forming processes such as electrophotography or electrostatic recording there are already known various methods of developing an electrostatic latent image formed on an image carrier such as a photosensitive element or an electrostatic recording material by means of a developer in liquid form (hereinafter referred to as liquid developer). Such liquid developing methods essentially consist of bringing a liquid developer, consisting of toner particles dispersed in an insulating carrier liquid having a volume resistivity in excess of $10^{10}$ Ω.cm and a dielectric constant smaller than 3, for example paraffinic hydrocarbons, into contact with a surface holding an electrostatic latent image thereon to deposit said toner particles onto said latent image on said surface, thereby rendering said latent image visible.

In such liquid developing methods the achievement of a high-speed development has been an important objective in recent years. In order to achieve such high-speed development it becomes necessary to supply a liquid developer of an elevated concentration to a latent image holding surface with a high speed and to perform efficient recovery of excessive liquid developer. It is also important to obtain a developed image of a satisfactory quality from which the liquid developer is sufficiently removed.

2. Description of the Prior Art

As a method approximately satisfying the above-mentioned requirements for the liquid development there is known a method of employing an elastic member capable of holding a liquid therein and provided with a liquid-permeable surface as a supply means for the liquid developer, and conducting the development of electrostatic latent image in a portion of image holding carrier where said elastic member is maintained in pressure contact therewith. Such method is regarded superior to other liquid developing methods for example utilizing a dipping tank of liquid developer or a jet of liquid developer in that the squeeze supply of liquid developer and suction removal of excessive liquid developer can be achieved simultaneously according to the pressure deformation of said elastic member. Said elastic member can be formed in a shape of a roller or of an endless rotary member (hereinafter referred to collectively as elastic roller). As an example of such elastic roller there is disclosed, for example in Japanese Laid-Open Patents Sho No. 52-40336 and Sho No. 52-55644, a developing roller of a structure in which the periphery of a sponge layer is covered with a flexible net member. Such elastic roller is regarded considerably suitable in the application for the development of an electrostatic latent image, as it can be maintained in pressure contact with a rigid member such as a photosensitive member or an insulating member to form a nip of a desired width therewith, squeezing out the liquid contained in said roller or absorbing the liquid thereinto.

For example, in case of an electrophotographic copying apparatus, the development with such elastic roller is conducted in a portion thereof in pressure contact with the surface holding the electrostatic latent image, and in the course of such development said roller is rotated in substantial synchronization with the advancement of said surface, i.e. so that said two members are stationary with respect to each other, in order not to distort or destruct the already formed developed image. It is also usual, while not in development, to interrupt the advancement of said surface and correspondingly the rotation of said roller. However such elastic roller, if left in a state the same as in the course of a developing operation even after the completion thereof, will result in various undesirable phenomena such as (1) gradual plastic deformation of the roller in the contact portion thereof with the image-holding surface with a corresponding loss of elasticity leading to an unsatisfactory development, (2) drying of liquid developer remaining in the vicinity of the contact portion of said roller with said image-holding surface, said liquid developer being solidified on said surface and rendering cleaning of said surface difficult when said surface is to be used again, and (3) gradual evaporation of the carrier liquid of the liquid developer from the roller surface, causing solidification of the liquid developer in the roller and deteriorating the liquid permeability of the roller and thus the developing performance thereof.

SUMMARY OF THE INVENTION

The principal object of the present invention, therefore, is to provide a process sequence capable of avoiding the above-mentioned drawbacks associated with the conventional liquid development utilizing such elastic roller and of constantly achieving satisfactory image formation and to provide an image forming apparatus adapted for embodying such process.

Another object of the present invention is to provide an image forming process utilizing an elastic roller capable of constantly providing a clear developed image of an elevated quality without background fog and also an apparatus adapted for embodying such process.

A still further object of the present invention is to provide an image forming process utilizing an elastic roller adapted for conducting high-speed copying in a conventionally unrealizable limited developing area and also an apparatus adapted for embodying such process.

A still further object of the present invention is to provide an image forming process utilizing an elastic roller which is capable of reducing exposure of liquid developer to the air and of recovery of excessive developer by enhanced squeezing thereby reducing consumption of liquid developer and also an apparatus adapted for embodying such process.

A still further object of the present invention is to provide an image forming apparatus provided with an elastic roller of improved service life.

According to one aspect of the invention, there is provided an image forming process including a step of developing an electrostatic image by supplying a liquid developer to a surface holding said image thereon, which comprises conducting said development when a liquid developer supply member capable, upon elastic deformation thereof, of squeezing out and absorbing said liquid developer is brought into pressure contact with said image-holding surface, and, when said development is not in execution, separating said supply member from said surface and maintaining said supply member in a state wetted with said liquid developer.

According to another aspect of the invention, there is provided an image forming apparatus provided with an electrostatic image-holding member, and a liquid developing means provided with a rotary member capable of supplying a liquid developer to and recovering excessive liquid developer from said image-holding member in pressure contact therewith for developing an electrostatic image formed on said image-holding member with said liquid developer and a container for holding said liquid developer in which said rotary member is to be at least partially immersed, comprising a means for bringing said rotary member into pressure contact with said image-holding surface when the development is being performed and separating said rotary member from said surface when the development is not being performed, and a means for stopping the rotation of said image-holding member, from which said rotary member is separated, after a displacement until a final contact portion of said image-holding member with said rotary member passes through a cleaning station.

According to further aspect of the invention, there is provided an image forming apparatus provided with an electrostatic image-holding member, and a liquid developing means provided with a rotary member capable of supplying a liquid developer to and recovering excessive liquid developer from said image holding member in pressure contact therewith for developing an electrostatic image formed on said image-holding member with said liquid developer and a container for holding said liquid developer in which said rotary member is to be at least partially immersed, comprising a means for bringing said rotary member into pressure contact with said image-holding member when the development is being performed and, when the development is not being performed, separating said rotary member from said image-holding member and displacing said rotary member with respect to said container in such a manner that said rotary member is substantially immersed in said liquid developer contained in said container.

DESCRIPTION OF THE PREFERRED EMBODIMENTS

The elastic roller to be employed as a liquid developer supplying means in the present invention may be of various structures, all of which cannot be enumerated herein, but there will be explained certain examples of structures shown in the attached drawings and relating to the description hereafter.

Figure 1:
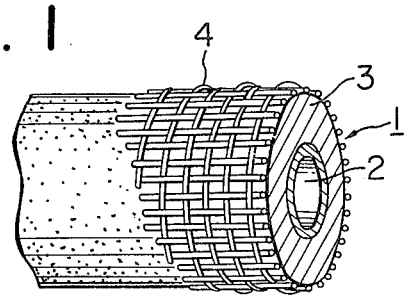
FIGS. 1 and 2 are schematic perspective views showing the representative structures of an elastic developing roller to be employed in the present invention.

In a representative example shown in FIG. 1, the elastic developing roller to be employed in the present invention is essentially composed of a central roller functioning as a rotary shaft, a porous elastic member provided therearound, and an outermost elastic member provided with a plurality of penetrating pores.

Figure 2:
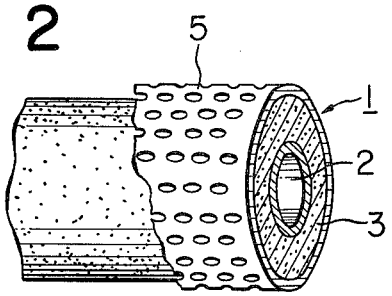

More specifically, in FIG. 1, the elastic roller 1 comprises a shaft 2 made of a rigid material such as a metal or a hard synthetic resin, an elastic foam member 3 consisting for example of foamed polyurethane and provided around said shaft 2, and a net member 4 covering said foam member 3. Said foam member 3 is fixed to said shaft 2 by means for example of an adhesive, while said net member 4 is supported around said foam member 3 by the recovering force of said foam member contained in said net member in a somewhat compressed state, so that said foam member 3 and net member 4 rotate integrally with said shaft 2 when it is driven. Also said roller is capable of squeezing out or absorbing a liquid since said foam member 3 is provided with elastically deformable continuous pores. The surface net member 4 is a flexible net woven from stainless thin wires or natural or synthetic fibers, through the textures of which the liquid can enter or come out from said foam member 3. More specifically, upon compression of elastic roller 1, the liquid impregnated in said foam member is squeezed to the outside through said textures, and upon recovery of the foam member 3 from the compressed state, the liquid present on the surface of said net member 4 is absorbed into the foam member 3 through said textures. In case of using a net member on the periphery of elastic member as in the present example, and for example for a developing roller for an electrophotographic copier, said net is preferably of 100–300 mesh. Further, in consideration of liquid permeability, mechanical strength, chemical stability etc., said net member is most preferably composed of a textile of monofilament fibers of polyamide, polyester, polypropylene, polyether, vinylon etc. Further, in case of using such net member, said net may be formed of plain weaving, twill weaving or satin weaving, or obtained by pressure deformation of a net formed of such weavings. Said net is provided on the foam member 3 in the example shown in FIG. 1 in such a manner that the direction of lateral fibers is parallel to the direction of rotary axis, but it is naturally possible also to provide an angle between the two directions. Furthermore, said elastic roller may naturally be of other various structure. In such case the outermost member may be composed of any material provided with penetrating holes interconnecting the interior of the elastic roller with the exterior thereof and further provided with an elasticity in a direction perpendicular to the external surface coming into contact with the other rigid surface, said penetrating holes to be maintained open even during said contact. The outermost member, therefore, is not limited to the net as explained in the foregoing but may also be composed of a thin metal plate or a plastic film provided with a plurality of holes as shown in FIG. 2, wherein a sleeve 5 is composed of a film provided with circular perforations. Furthermore the form of said perforations is not limited to a circular shape but can also be rectangular, oval, mosaic-shaped or of combinations thereof. Furthermore the foam member 3 shown in FIGS. 1 and 2 is not necessarily composed of a single layer but may be composed of a plurality of layers if desirable.

Said foam member 3 can be composed of any material capable of squeezing out and absorbing a liquid and provided with a suitable elasticity, for example a plastic foam composed of polystyrene, polyethylene, polyurethane, polyvinyl chloride, nitrile-butylene rubber etc., or an elastic member formed of natural, synthetic or metal fibers. Such foam member 3 generally contains continuous pores capable of holding and permeating a liquid, and independent pores not contributing to the liquid permeation.

The central shaft 2 functions to support said foam member 3 and is generally composed of a rigid material for example a metal such as aluminum or a plastic material such as polyoxymethylene, polyamide etc.

In the above-mentioned structure the foam member 3 is preferably adhered to the central shaft 2, while the net member 4 is preferably not adhered to said foam member in order to facilitate liquid squeezing and absorption by said foam member 3.

Furthermore, said elastic roller may function as a proximity electrode to the photosensitive element if at least a constituent member of said roller is rendered electroconductive, thereby exhibiting a further improved developing effect and recovery of excessive liquid developer.

Figure 3:
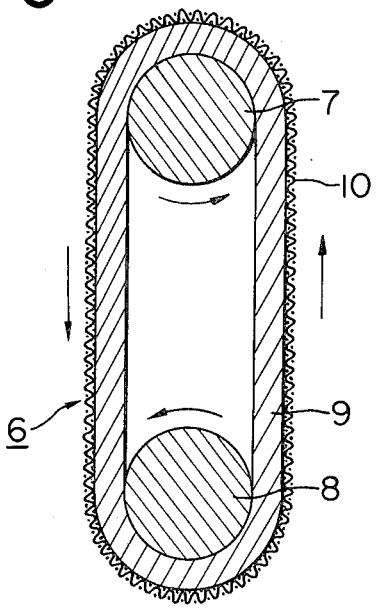
FIG. 3 is a schematic cross-sectional view showing the structure of an elastic developing belt.

According to the present invention, the elastic roller shown in FIGS. 1 and 2 may also be formed, as a variation, in the shape of a belt as shown in FIG. 3, wherein an elastic belt 6 is formed so that an elastic foam member 9 is rotated by two rollers 7, 8, said foam member 9 being provided on the surface thereof with a net member 10. Said belt 6 may be composed of the materials described in connection with the embodiments shown in FIGS. 1 and 2, and the rotation of the foam member 9 can be made secure and smooth for example by employing a material of high friction resistance on one side of said foam member 9 contacting said rollers 7, 8 or by rendering the surface of said rollers 7, 8 coarse.

Now there will be considered the prior drawbacks in the case the elastic roller shown in FIG. 1 is applied to a developing section in an actual image forming apparatus.

Figure 4:
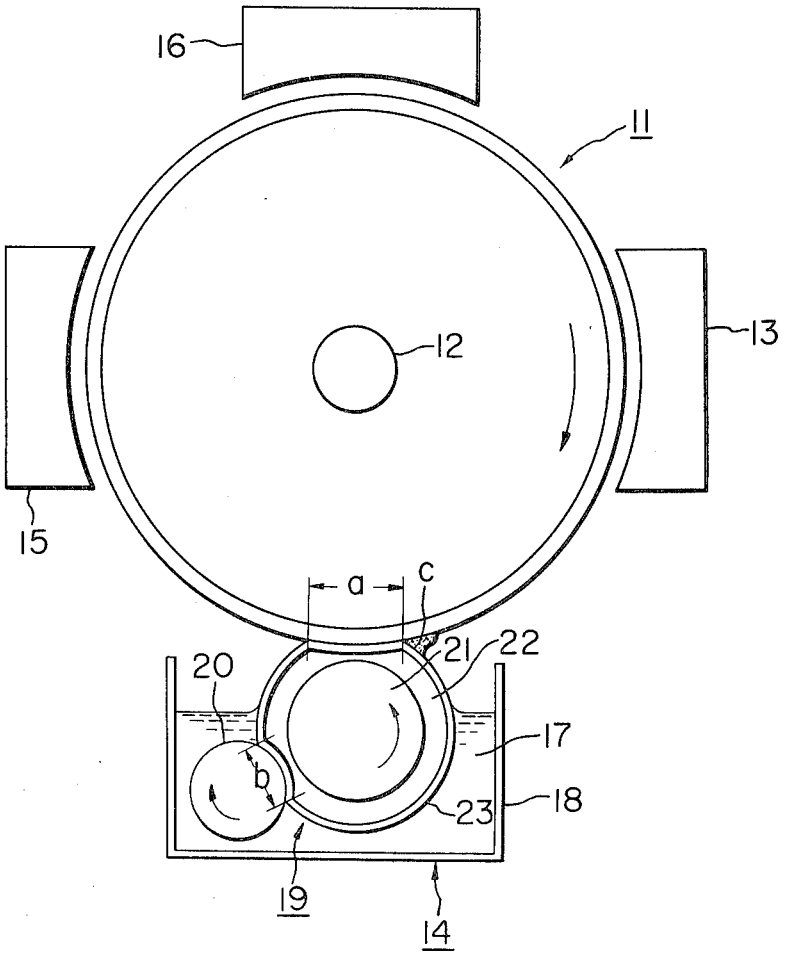
FIG. 4 is a schematic view of an image forming apparatus employing the elastic developing roller shown in FIG. 1.

Referring to FIG. 4 showing a schematic cross-sectional view of an electrophotographic copier, there are shown a photosensitive member 11 of a drum shape rotated in a direction of arrow around a rotary shaft 12, a latent image forming station 13 forming an imagewise latent image on said photosensitive member 11, a developing station 14, a transfer station 15 for transferring a developed image onto a transfer material, and a cleaning station 16 for removing unnecessary developer from the photosensitive member and erasing unnecessary latent image. Said developing station 14 is provided under said photosensitive member 11 and is essentially composed of a liquid tank 18 for holding liquid developer 17, a developing roller 19 partially immersed in the liquid developer 17 contained in said tank 18, and a squeeze roller 20 maintained in pressure contact with said developing roller 19. As already explained in relation with FIG. 1, the developing roller 19 is provided with a central shaft roller 21, an elastic foam member 22 composed of foamed polyurethane and provided around said roller 21, and an endless net 23 encircling said foam member 22. The photosensitive member 11 and the developing roller 19 are rotated, in a mutually pressed state, in the same peripheral direction represented by the arrows at substantially the same speeds. The developing roller 19 comes into contact with the photosensitive member 11 in a state sufficiently impregnated with liquid developer 17 to form a nip portion (a) with said photosensitive member 11, and the liquid developer (c) squeezed from said developing roller and that (a) present between the photosensitive member 11 and the developing roller 19 perform the development of electrostatic image formed on said photosensitive member 11.

Successively, when the compressed portion of the developing roller 19 leaves the photosensitive member 11, the excessive liquid developer present in the vicinity of the photosensitive member 11 is absorbed by the recovering force of the elastic foam member 22. Then the developing roller 19 is brought into pressure contact with the squeeze roller 20 in the liquid developer 17 to replace and replenish the liquid developer contained in the developing roller thereby being prepared for the next developing cycle.

In case the apparatus is stopped and let to stand in a state shown in FIG. 4, the developing roller 19 causes a plastic deformation in the contact portion (a) with the photosensitive member 11 and also in the contact portion (b) with the squeeze roller 20, if employed, showing a reduced absorbing ability and a reduced squeezing ability resulting from an elastic (mainly compression) deformation, thus leading to a lower image density in the portion developed by the thus plastically deformed part of developing roller 19 and also to an unnecessarily large amount of liquid developer left on the photosensitive member 11. These phenomena are already explained as the drawback (1). In order to avoid such drawback it can be considered to separate, when the apparatus is stopped and left unoperated, the developing roller 19 from the photosensitive member 11 and from the squeeze roller 20, and to retract said roller 19 to a position not subjected to any external pressure. In such method, however, there still remains the aforementioned drawback (2) that the liquid developer remaining on the portions (a) and (c) on the photosensitive member 11, after the developing roller 19 is left therefrom, is solidified on the photosensitive member 11 and becomes not easily cleanable. Also there still is the aforementioned drawback (3) that the carrier liquid evaporates from the surface of a portion of developing roller 19 not immersed in the liquid developer 17, particularly from a surface portion distant from the liquid developer level, whereby the pores of rollers 19 are clogged with the solid content of liquid developer and are deprived of the ability to suck the liquid developer therein, thus leading to a lower image density developed by the portion of such pores.

Thus the present invention is to provide an image forming process sequence completely free from the above-mentioned drawbacks and an apparatus adapted for embodying such sequence.

In the following there will be explained various embodiments of the present invention applied, as shown in the attached drawings, to an electrophotographic copier which repeatedly performs the steps of forming an electrostatic image on a photosensitive drum, developing said image with an elastic developing roller as shown in FIG. 1, transferring thus developed image onto a transfer material and cleaning the excessive liquid developer on said drum.

In the following embodiments the same components as those in FIG. 4 are represented by same numbers as in FIG. 4.

Figure 5:
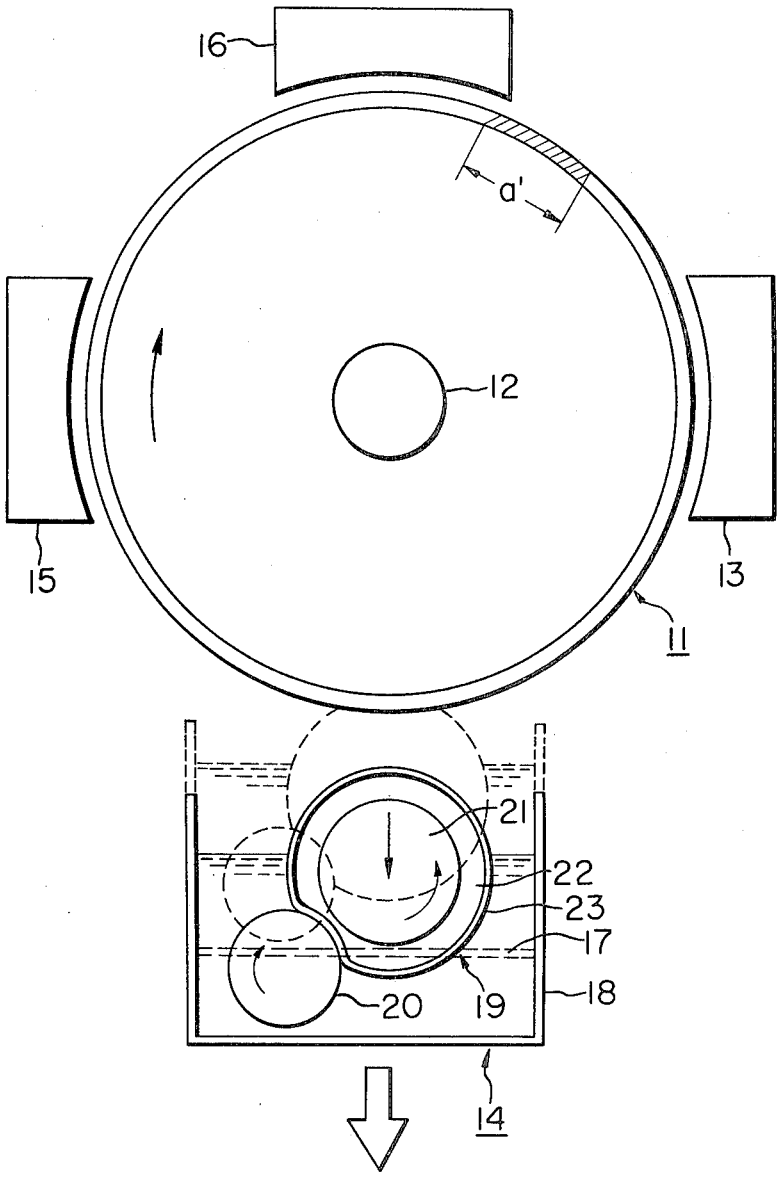
FIGS. 5–8 are schematic cross-sectional views of various embodiments of the present invention applied in an electrophotographic copier.

Referring to FIG. 5 which is a schematic cross-sectional view of an embodiment of the present invention, wherein there are shown, in a substantially same manner as in FIG. 4, a photosensitive member 11 in a drum shape rotated in a direction of arrow around a rotary shaft 12, a latent image forming station 13 for forming an imagewise latent image on said photosensitive member 11, a developing station 14, a transfer station 15 for transferring a developed image onto a transfer material, and a cleaning station 16 for removing unnecessary developer on the photosensitive member and for erasing unnecessary latent image. Said developing station 14 is located under said photosensitive member 11 and is essentially composed of a liquid tank 18 for holding liquid developer 17, a developing roller 19 partially immersed in the liquid developer 17 contained in said liquid tank 18, and a squeeze roller 20 maintained in pressure contact with said developing roller 19. As already explained in relation to FIG. 1, said developing roller 19 is provided with a central shaft roller 21, an elastic foam member 22 consisting of foamed polyurethane and provided around said roller 21, and an endless net 23 encircling said foam member 22.

Now there will be explained the function of the apparatus shown in FIG. 5. When the trailing end of electrostatic image on the photosensitive member 11 passes through the developing station 14, the entire developing station 14 is displaced, without any modification in the structure thereof including the developing roller 19, from the broken-lined position to the full-lined position.

Even after being disconnected from the photosensitive member 11, the developing roller 19 in the developing station 14 continues to be driven in the direction of arrow (or in the opposite direction as the case may be) whereby the liquid developer in the developing roller 19 is constantly replaced and replenished by pressure contact with the squeeze roller 20, and the roller 19 is constantly wetted with the liquid developer 17. It is further possible, though not illustrated, to modify the structure in such a manner that the developing roller 19, after being disconnected from the photosensitive member 11, is also relieved from the pressure contact with the squeeze roller 20 and is rotated alone. Also in this case the developing roller 19, or at least the surface portion thereof, is constantly wetted with the liquid developer 17. Also it is preferable that the rotation of photosensitive member 11 is stopped, upon separation of developing roller 19 as illustrated, after the final contact portion a' with said developing roller passes at least through the cleaning station 16, and it is made possible, in this manner, to prevent the inconveniences resulting from the solidification of liquid developer on the portion a' of the photosensitive member 11.

It is to be noted that the direction of displacement of developing station 14 is not necessarily limited to that shown in the drawing but may also be in lateral direction in the drawing, as long as the photosensitive member 11 and developing roller 19 are mutually separated.

Figure 6:
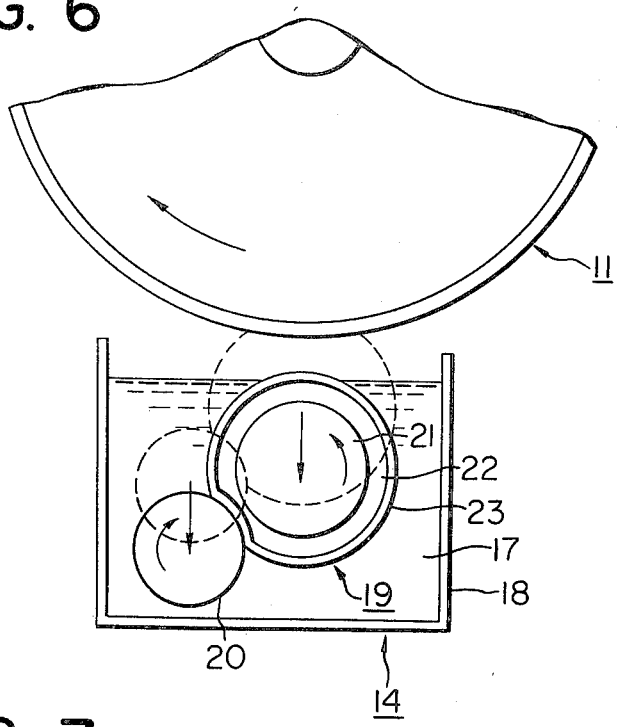

Referring to FIG. 6 which is a schematic cross-sectional view of an electrophotographic copier, principally the developing station thereof, showing an another embodiment of the present invention, wherein the components corresponding to those in FIG. 5 are represented by corresponding numbers, the developing roller 19, after being separated from the photosensitive member 11, is displaced together with the squeeze roller 20 from the broken-lined position to the full-lined position without changing the position of the liquid tank 18 so that the developing roller 19 becomes substantially entirely immersed in the liquid developer 17. In this case the developing roller 19 may be stopped or driven intermittently, but preferably continues to be driven in the direction of arrow or in the opposite direction since in this manner the entire developing roller 19 can be maintained in wet state and the liquid developer contained therein can be maintained at a constant concentration. Also in this embodiment the squeeze roller 20 may be released from pressure contact if desirable. Further, though not illustrated, the rotation of photosensitive member 11, upon separation of the developing roller 19 therefrom, is preferably not stopped until the final contact portion of the photosensitive member 11 with said developing roller 19 passes at least through the cleaning station.

Figure 7:
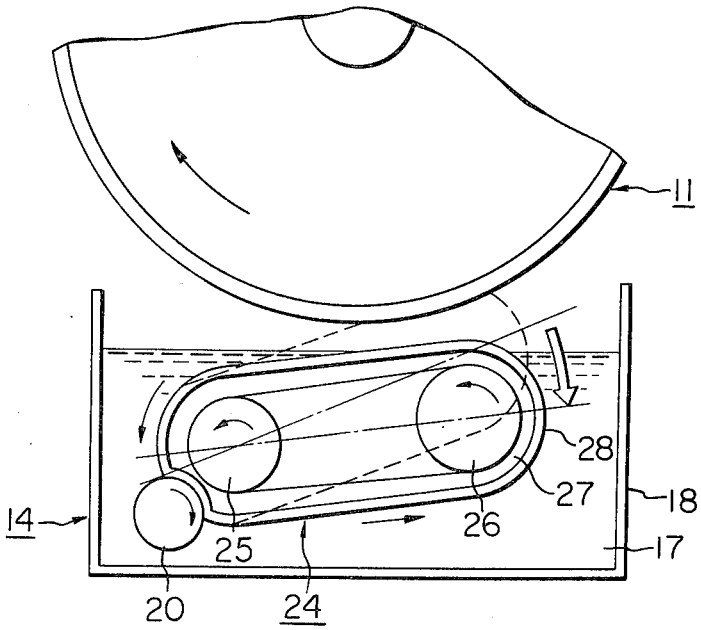

Referring to FIG. 7 which is a schematic cross-sectional view of the developing station of an electrophotographic copier showing a variation of the embodiment shown in FIG. 6, there is employed an elastic developing belt as shown in FIG. 3 in place of the foregoing elastic developing roller. In FIG. 7 there are shown a photosensitive member 11 of a drum shape rotated in the direction of arrow, and a developing station 14 provided under said photosensitive member 11 and essentially composed of a liquid tank 18 for holding liquid developer 17, a developing belt 24 partially immersed in the liquid developer 17 contained in said liquid tank 18 and a squeeze roller 20 maintained in pressure contact with said belt 24. As already explained in relation with FIG. 3, the developing belt 24 is composed in such a manner that an endless belt consisting of an elastic foam member 27 and a net member 28 provided on the surface thereof is rotated around two rollers 25 and 26. Upon separation from the photosensitive member 11, the developing belt 24 is substantially entirely immersed in the liquid developer 17 by displacing the roller 26 alone in the direction of arrow from the broken-lined position to the full-lined position while the roller 25 and the squeeze roller 20 are maintained stationary. After being substantially immersed in the liquid developer 17, the belt 24 may be stopped or driven continuously, but it is preferably maintained in driven state for the reason already explained.

Figure 8:
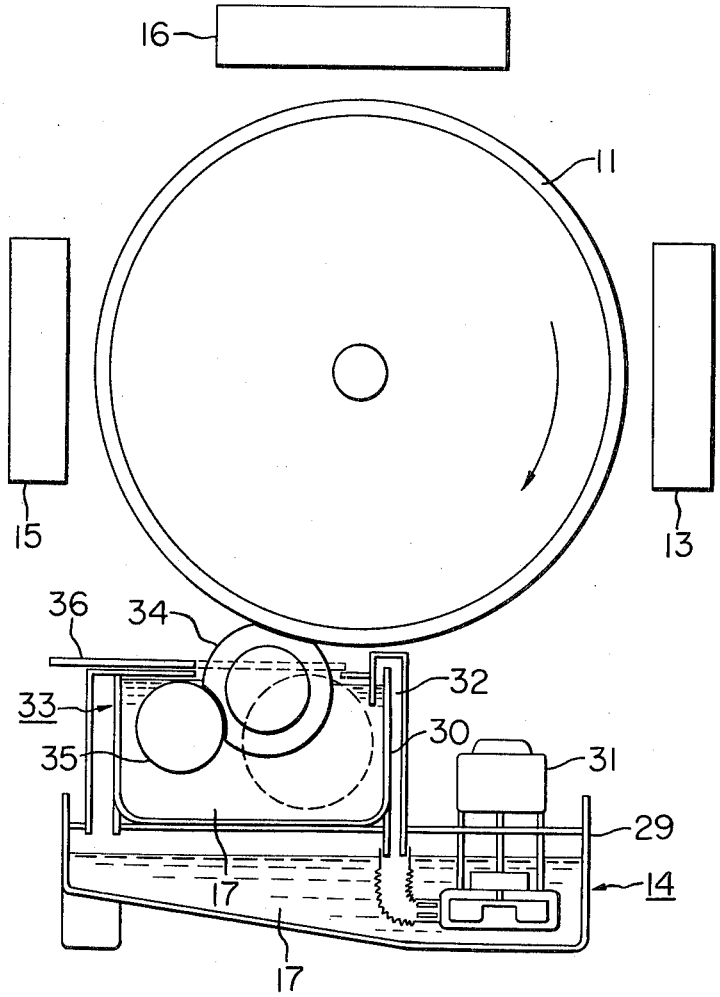

Referring to FIG. 8 which is a schematic cross-sectional view of an electrophotographic copier showing an another embodiment of the present invention, a photosensitive member 11 of a drum shape is rotated in the direction of arrow and repeats the copying operation, passing through a latent image forming station 13, a developing station 14, a transfer station 15 and a cleaning station 16. Said developing station 14 is essentially composed of a container 29 for liquid the developer and a container 30 for developing roller, and the liquid developer 17 is agitated and supplied, by means of an agitating motor 31 provided on said container 29, to said container 30 for developing roller through a supply path 32. The liquid developer 17 overflowing from the container 30 for developing roller is returned to the container 29 through a return path 33. Said container 30 is provided with a developing roller 34 and a refresh roller 35 which are respectively rendered rotatable, said developing roller 34 being further rendered displaceable to the broken-lined position.

Upon passing of the trailing end of image of a final copy through said developing station 14, said developing roller 34 is displaced from the full-lined position to the broken-lined position. In this case it is required that the developing roller 34 in the broken-lined position is separated from other components. Also it is preferable that the developing roller 34 continues to be rotated after separation from the photosensitive member 11 and the displacement of said roller to the broken-lined position is conducted after the developing roller 34 is rotated at least a full turn in contact with the refresh roller 35 in order to render uniform the concentration of liquid developer contained in the developing roller 34. The photosensitive member 11, upon separation of developing roller 34 therefrom, is stopped at least after a half turn for cleaning the entire periphery thereof by the cleaning station 16. Though the developing roller 34, in the broken-lined position, is preferably immersed entirely in the liquid developer 17 contained in the container 34, a partial immersion is also acceptable. Also the container 30 for developing roller is preferably of a totally closed structure preventing the evaporation of the liquid developer, since said container should preferably be filled with the liquid developer regardless of the function of agitating motor 31. In the present embodiment the container 30 for the developing roller is provided at the upper part thereof with a slidable cover 36 which is displaced to a broken-lined position to close said container 30 after the developing roller 34 is displaced to the corresponding broken-lined position.

The present embodiment is therefore featured by the facts that:

i. the developing roller is maintained in pressure contact with the photosensitive member during the copying operation;

ii. upon completion of copying the developing roller is separated from the photosensitive member which is still maintained in rotation;

iii. the rotation of the photosensitive member is not stopped until the final contact portion thereof with the developing roller passes through at least the cleaning station; and iv. the developing roller, after being separated from the photosensitive member, is displaced to a position where the developing roller can be immersed in the liquid developer as much as possible.

The process sequence explained in the foregoing allows one to obtain a clear image from the first copy even after the apparatus is left unused for a prolonged period.

The present invention detailedly explained in the foregoing is capable of providing, in summary, the following advantages:

(1) the the image formation of an elevated quality can always be maintained in a stable manner as the characteristics of liquid developer supplying means can be maintained for a prolonged period;

(2) that an image without density unevenness and background fog can be obtained for a prolonged period;

(3) that a satisfactory development can be achieved even immediately after the start of copying operation;

(4) that a conventionally unfeasible high-speed image formation is achievable since the effective developing time is extremely short and the removal of excessive liquid developer is achieved simultaneously;

(5) that the entire image forming apparatus can be of a simpler structure as there is not required a conventionally separate squeezing means;

(6) that the developed image is of an elevated quality without distortion and the consumption of liquid developer is limited since the liquid developer is constantly squeezed off in an elevated degree;

(7) that the concern for pollution is reduced since the carry-over of liquid developer, and thus the evaporation thereof to the outside, are limited; and (8) that the development can be more effectively conducted in a smaller space than in the conventional apparatus.

What we claim is:

1. In an image forming process for developing an electrostatic image with liquid developer which comprises the steps of performing liquid development by moving an elastic liquid developer supply member capable, upon elastic deformation thereof, of squeezing out and absorbing liquid developer into pressure contact with an image-holding surface bearing the electrostatic image, displacing said image-holding surface during the development, and separating said supply member from said surface after development, the improvement comprising the steps of immersing substantially the entire liquid developer supply member within the liquid developer after its separation from the image-holding surface so that its elastic material is maintained wet throughout after the development has been completed, and then stopping the displacement of said image-holding surface after the final contact portion of said surface when said supply member has been cleaned.

2. A process according to claim 1, further comprising the step of rotating said liquid developer supply member while it is substantially immersed in said liquid developer.

3. A process according to claim 1, wherein the development of the electrostatic image is conducted while said liquid developer supply member is maintained in pressure contact with said image-holding surface in a substantially static manner with respect to said surface.

4. A process according to claim 1, further comprising the step of absorbing and replenishing liquid developer to said supply member while said supply member is substantially fully immersed in said liquid developer.

5. A process according to claim 1, wherein said liquid developer supply member is rotated during development and is maintained in rotation when substantially fully immersed in said liquid developer.

6. A process according to claim 1 or 2, wherein the absorption and replenishment of liquid developer to said supply member are terminated when the supply member is substantially immersed in said liquid developer.

* * * * *